US006575102B2

(12) United States Patent
Norton et al.

(10) Patent No.: US 6,575,102 B2
(45) Date of Patent: Jun. 10, 2003

(54) TEMPERATURE CONTROLLED RAILWAY CAR

(75) Inventors: Allen E. Norton, Arlington, TX (US); Stephen W. Smith, Dallas, TX (US); Alex K. Hoover, Ft. Worth, TX (US); Albert A. Beers, Duncanville, TX (US); Robert J. Barry, Arlington, TX (US); Gary W. Kirk, Jr., Piedmont, OK (US); Joseph A. Seiter, Edmond, OK (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 10/071,168

(22) Filed: Feb. 8, 2002

(65) Prior Publication Data

US 2002/0148381 A1 Oct. 17, 2002

Related U.S. Application Data

(60) Provisional application No. 60/267,882, filed on Feb. 9, 2001.

(51) Int. Cl.[7] ..... B61D 17/00

(52) U.S. Cl. ..... 105/423; 105/404; 105/409

(58) Field of Search ..... 105/396, 423, 105/422, 404, 409, 410, 413, 355; 220/1.5, 592.2; 52/404.1; 296/180.3, 191, 197, 183, 187, 188

(56) References Cited

U.S. PATENT DOCUMENTS

| | | | | |
|---|---|---|---|---|
| 3,003,810 A | | 10/1961 | Kloote | 296/31 |
| 3,142,265 A | * | 7/1964 | Ford | 105/423 |
| 3,187,853 A | | 6/1965 | Glaser et al. | 189/34 |
| 3,301,147 A | | 1/1967 | Clayton et al. | |
| 3,711,148 A | * | 1/1973 | Hindin | 296/183 |
| 3,777,430 A | | 12/1973 | Tischuk | 52/309 |
| 4,122,641 A | | 10/1978 | Bard et al. | 52/403 |
| 4,404,057 A | | 9/1983 | Morrison et al. | 156/324 |
| 5,274,979 A | | 1/1994 | Tsai | 52/595 |
| 5,277,011 A | | 1/1994 | Serrano Martin | 52/588 |
| 5,403,063 A | | 4/1995 | Sjostedt et al. | 296/187 |
| 5,677,029 A | | 10/1997 | Prevorsek et al. | 428/113 |
| 5,716,487 A | | 2/1998 | Sumerak | 156/359 |
| 5,730,485 A | | 3/1998 | Sjostedt et al. | 296/182 |
| 5,765,485 A | | 6/1998 | Thoman et al. | 105/404 |
| 5,988,074 A | | 11/1999 | Thoman | 105/404 |
| 6,000,342 A | | 12/1999 | Thoman et al. | 105/413 |
| 6,138,580 A | | 10/2000 | Thoman | 105/396 |
| 6,233,892 B1 | | 5/2001 | Tylman | 52/309.12 |
| 6,251,185 B1 | | 6/2001 | Morrison et al. | 118/681 |
| 6,290,279 B1 | | 9/2001 | Haight et al. | 296/97.23 |

OTHER PUBLICATIONS

Trinity Vision News Letter—Railcar News from Trinity Industries, Fall 2000 pp 1–8, 2000.

* cited by examiner

*Primary Examiner*—Mark T. Le
(74) *Attorney, Agent, or Firm*—Baker Botts L.L.P.

(57) ABSTRACT

A composite box structure assembled on and securely attached to a railway car underframe to form a temperature controlled railway car or on insulated boxcar. The composite box structure defined in part by an exterior metal surface, interior side stakes and at least one layer of fiber reinforced plastic attached to the side stakes. Foam insulation may be disposed between the side stakes, the exterior metal surface and the at least one layer of fiber reinforced plastic. The foam insulation provides improved resistance to heat transfer between the interior and the exterior of the composite box structure. An airflow management system may be incorporated into the composite box structure.

17 Claims, 9 Drawing Sheets

43
40
45
38
45
44
142
130
140
48
47
48
130
74
46
39
46
39
74
128
129
58
58
32
126
60
60
30
126
54
127
127
61
61
58
122
120
58
56
60
60
126
126
53
127
127
53
75
100
82
84a
88
75
55
55
246
246
54
221
248
248
221
84b
220
222
230
230
223
223
200

TEMPERATURE CONTROLLED RAILWAY CAR

RELATED APPLICATION

This application claims the benefit of provisional application entitled, "Temperature Controlled Railway Car", Serial No. 60/267,882 filed Feb. 9, 2001.

This application is related to patent application Ser. No. 10/071,165, entitled, "Pultruded Panel", filed Feb. 8, 2002; patent application Ser. No. 10/071,173, entitled "Roof Assembly and Airflow Management System for A Temperature Controlled Railway Car", filed Feb. 8, 2002; and patent application Serial No. 10/071,513, entitled "Manufacturing Facility and Method of Assembling Temperature Controlled Railway Car", filed Feb. 8, 2002

TECHNICAL FIELD

The present invention is related to a composite box structure and more particularly to a composite box structure assembled on and attached to a railway car underframe to provide an insulated railway boxcar or a temperature controlled railway car.

BACKGROUND OF THE INVENTION

Over the years, general purpose railway boxcars have progressed from relatively simple wooden structures mounted on flat cars to more elaborate arrangements including insulated walls and refrigeration equipment. Various types of insulated boxcars are presently manufactured and used. A typical insulated boxcar includes an enclosed structure mounted on a railway car underframe. The enclosed structure generally includes a floor assembly, a pair of side walls, a pair of end walls and a roof. The side walls, end walls and roof often have an outer shell, one or more layers of insulation and interior paneling.

The outer shell of many railway boxcars often has an exterior surface formed from various types of metal such as steel or aluminum. The interior paneling is often formed from wood and/or metal as desired for the specific application. For some applications the interior paneling has been formed from fiber reinforced plastic (FRP). Various types of sliding doors including plug type doors are generally provided on each side of conventional boxcars for loading and unloading freight. Conventional boxcars may be assembled from various pieces of wood, steel and/or sheets of composite materials such as fiberglass reinforced plastic. Significant amounts of raw material, labor and time are often required to complete the manufacture and assembly of conventional boxcars.

The underframe for many boxcars include a center sill with a pair of end sill assemblies and a pair of side sill assemblies arranged in a generally rectangular configuration corresponding approximately with dimensions for the floor of the boxcar. Cross bearer 217 are provided to establish desired rigidity and strength for transmission of vertical loads to the associated side sills which in turn transmit the vertical loads to the associated body bolsters and for distributing horizontal end loads on the center sill to other portions of the underframe. Cross bearer 217 and cross tie 216 cooperate with each other to support a plurality of longitudinal stringers. The longitudinal stringers are often provided on each side of the center sill to support the floor of a boxcar. Examples of such railway car underframes are shown in U.S. Pat. Nos. 2,783,718 and 3,266,441.

Some railway cars or boxcars may be manufactured using side wall assemblies with all or portions of a respective side sill assembly formed as an integral component thereof. In a similar manner, such railway cars and/or boxcars may also be manufactured with end wall assemblies having all or portions of a respective end sill formed as an integral component thereof.

Traditionally, refrigerated boxcars often have less inside height than desired for many types of lading and a relatively short interior length. Heat transfer rates for conventional insulated boxcars and refrigerated boxcars are often much greater than desired. Therefore, refrigeration systems associated with such boxcars must be relatively large to maintain desired temperatures while shipping perishable lading.

A wide variety of composite materials have been used to form railway cars and particular boxcars. U.S. Pat. No. 6,092,472 entitled "Composite Box Structure For A Railway Car" and U.S. Pat. No. 6,138,580 entitled "Temperature Controlled Composite Boxcar" show some examples. One example of a composite roof for a railway car is shown in U.S. Pat. No. 5,988,074 entitled "Composite Roof for a Railway Car".

Ballistic resistant fabrics such as Bulitex scuff and wall liners have previously been used to form liners for highway truck trailers.

SUMMARY OF THE INVENTION

In accordance with teachings of the present invention, several disadvantages and problems associated with insulated boxcars, refrigerated boxcars and other types of temperature controlled railway cars have been substantially reduced or eliminated. One embodiment of the present invention includes a composite box structure with a temperature control system and an airflow management system satisfactory for use with a refrigerated boxcar or a temperature controlled railway car. Another embodiment of the present invention includes a composite box structure which may be satisfactory for use with an insulated boxcar. A composite box structure formed in accordance with teachings of the present invention combines benefits conventional railway car components with benefits of advanced plastic and composite materials. For one application a temperature controlled railway car may be formed in accordance with teachings with the present invention with enlarged interior dimensions of approximately seventy two feet, two inches inside length, nine feet, two inches inside width and an inside height at the center line of twelve feet, one and one half inches.

A composite box structure formed in accordance with teachings of the present invention provides enhanced insulation, increased load carrying capacity, better temperature regulation, increased service life, and reduced maintenance costs as compared to a typical refrigerated boxcar. The present invention allows designing side wall assemblies and end wall assemblies with insulating materials having optimum thickness to substantially minimize heat transfer rates between the interior and the exterior of a resulting composite box structure and to maximize interior load carrying capacity. Structural integrity of a resulting composite box structure may be maintained using conventional materials such as steel alloys to form exterior portions and supporting structures of the side wall assemblies and end wall assemblies.

A composite box structure for a railway car may be formed in accordance with teachings of the present invention with similar or reduced costs as compared to conventional refrigerated boxcars and insulated boxcars and with substantially improved load carrying capacity and thermal energy characteristics. Many structural members of the resulting railway car may be formed from steel alloys and other materials which may be easily repaired as compared with some composite materials. Composite materials with substantially improved insulation characteristics are used as nonstructural members to improve heat transfer characteristics while at the same time increasing load carrying capability.

A further aspect of the present invention includes a method of forming side walls and end walls for a composite box structure defined in part by a plurality of side stakes or support posts with metal side sheets attached to one side of the side stakes and at least one layer of ballistic resistant fabric attached to the opposite side of the side stakes with void spaces formed therebetween. The end wall assemblies and the side wall assemblies may be placed in a foam press with the respective assemblies tilted at an angle of approximately ten (10) degrees. Polyurethane foam or other types of insulating foam having high thermal insulation characteristics may be injected into void spaces formed between the side stakes, the exterior metal sheets and the interior ballistic resistant fabric.

Technical benefits of the present invention include covering the interior surface of metal components used to form the composite box structure with one or more layers of insulating material. For some applications strips of pultruded glass fiber trim may be placed on metal door posts and other metal portions of associated door frames. Blocks of polyurethane foam may also be installed at corner joints between associated side wall assemblies and end wall assemblies.

Forming side wall assemblies and end wall assemblies with all or at least portions of respective side sill assemblies and end sill assemblies as an integral part thereof allows optimizing associated fabrication techniques and reduces both cost and time required to complete manufacture and assembly of the resulting temperature controlled railway car or insulated boxcar. Various benefits associated with fabricating side wall assemblies and end wall assemblies in accordance with teachings of the present invention will be discussed throughout this patent application.

BRIEF DESCRIPTION OF THE DRAWINGS

For a more complete understanding of the present invention, and the advantages thereof, reference is now made to the following written description taken in conjunction with the accompanying drawings, in which.

DETAILED DESCRIPTION OF THE INVENTION

Preferred embodiments of the invention and its advantages are best understood by reference to FIGS. 1A–19 of the drawings, like numerals are used for like and corresponding parts of the various drawings.

Various aspects of the present invention will be described with respect to temperature controlled railway car 20. However, the present invention is not limited to temperature controlled railway cars. For example, various features of the present invention may be satisfactorily used to form insulated boxcars and other types of freight cars or railway cars having side wall assemblies and end wall assemblies mounted on a railway car underframe.

Figure 1A:
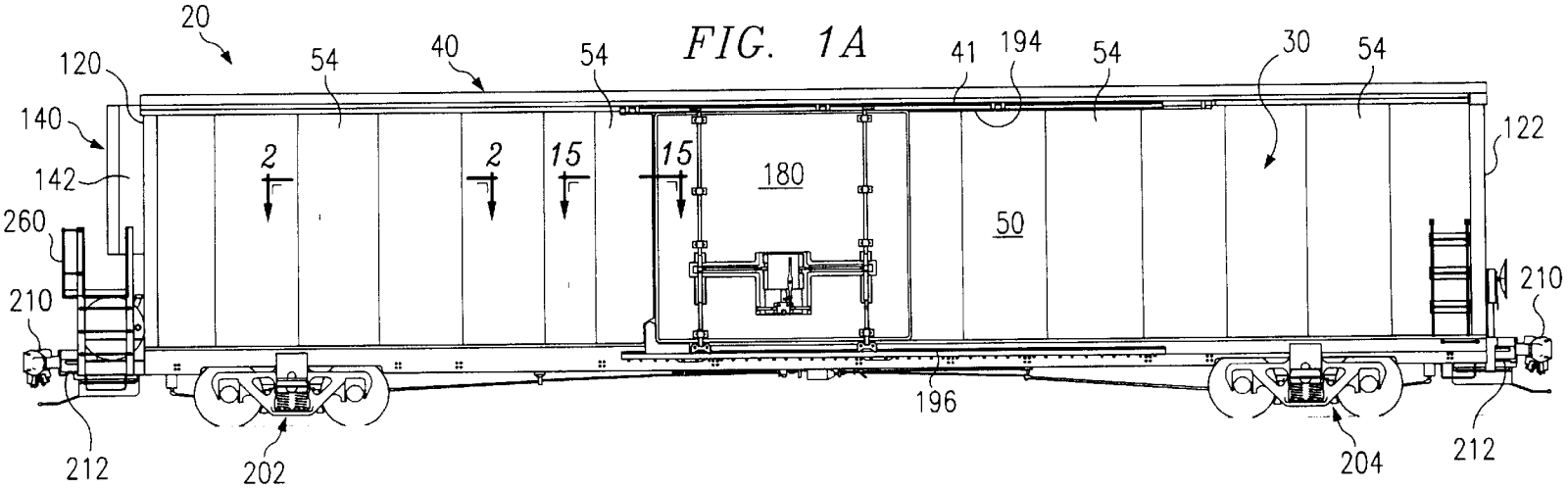
FIG. 1A is a schematic drawing in elevation showing a side view of a temperature controlled railway car having a composite box structure with a temperature control system and an airflow management system incorporating teachings of the present invention.
Figure 1B:
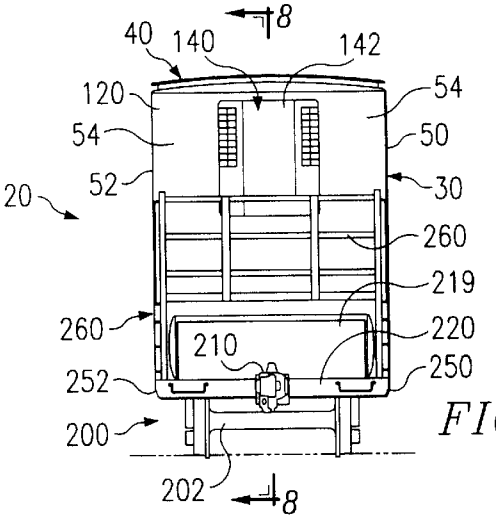
FIG. 1B is an end view of the temperature controlled railway car of FIG. 1A.

Temperature controlled railway car 20 incorporating teachings of the present invention is shown in FIGS. 1A and 1B with composite box structure 30 mounted on railway car underframe 200. As discussed later in more detail, temperature controlled railway car 20 may include temperature control system 140 and airflow management system 300.

For embodiments of the present invention as shown in FIGS. 1A–19, temperature controlled railway car 20 may have exterior dimensions which satisfy requirements of Plate F and associated structural design requirements of the Association of American Railroads (AAR). Forming various components of composite box structure 30 in accordance with teachings of the present invention and assembling these components on railway car underframe 200 results in reducing the weight of temperature controlled railway car 20 while at the same time increasing both internal volume and load carrying capacity as compared to many conventional refrigerated boxcars satisfying Plate F requirements. A composite box structure and associated insulated boxcar or temperature controlled railway car may be formed in accordance with teachings of the present invention to accommodate various geometric configurations and load carrying requirements to meet specific customer needs concerning size and temperature specifications of different types of lading carried in the resulting boxcar.

The term "composite box structure" refers to a generally elongated structure having a roof assembly, a floor assembly, a pair of side wall assemblies, and a pair of end wall assemblies which cooperate with each other to provide a generally hollow interior satisfactory for carrying different types of lading associated with insulated boxcars and refrigerated boxcars. Portions of the roof assembly, floor assembly, side wall assemblies and/or end wall assemblies may be formed from conventional materials such as steel alloys and other metal alloys used to manufacture railway cars. Portions of the roof assembly, floor assembly, side wall assemblies and/or end wall assemblies may also be formed from composite materials such as advanced thermal plastics, insulating foam, fiber reinforced plastics, glass fiber pultrusions and ballistic resistant fabrics. Examples of some of the materials used to form a composite box structure incorporating teachings of the present invention are discussed throughout this application.

The term "FRP" may be used to refer to both fiber reinforced plastic and glass fiber reinforced plastic. A wide variety of fibers in addition to glass fibers may be satisfactory used to form portions of a composite box structure incorporating teachings of the present invention.

Composite box structure 30 may be formed from several major components including roof assembly 40, side wall assemblies 50 and 52, floor assembly 80 and end wall assemblies 120 and 122. Major components associated with composite box structure 30 are preferably fabricated individually in accordance with teachings of the present invention and then attached to or assembled on railway car underframe 200 to form temperature controlled railway car 20. Individually manufacturing or fabricating major components of composite box structure 30 allows optimum use of conventional railcar manufacturing techniques. For example, side stakes and door posts may be welded with top cords and bottom chords using conventional railcar manufacturing techniques to provide structural members for a side wall assembly.

Manufacturing procedures associated with thermoplastic materials and foam insulation may be modified in accordance with teachings of the present invention to form other portions of composite box structure 30. For example, side wall assemblies and end wall assemblies may be formed with relatively thick foam insulation disposed between exterior side sheets and a layer of fiber reinforced plastic by injecting liquid insulating foam therebetween. Support posts and/or end beams may also be disposed between and attached to adjacent portions of the side sheets and associated layers of fiber reinforced plastic. A composite box structure formed in accordance with teachings of the present invention will often provide substantially improved heat transfer characteristics as compared with conventional insulated boxcars and conventional refrigerated boxcars.

Figure 2:
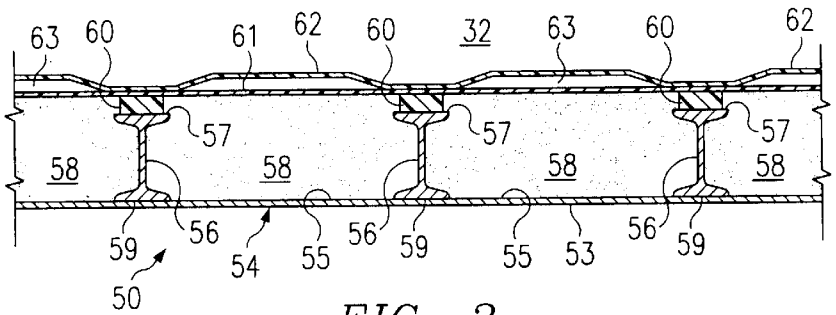
FIG. 2 is a schematic drawing in section with portions broken away showing a portion of a side wall assembly for a composite box structure incorporating teachings of the present invention.

Side wall assemblies 50 and 52 have substantially the same configuration and overall design. Therefore, various features of the present invention will be discussed primarily with respect to side wall assembly 50. A portion of side wall assembly 50 is shown in FIG. 2. For this embodiment, side wall assembly 50 preferably includes a plurality of metal side sheets 54 disposed on the exterior thereof. Side sheets 54 cooperate with each other to form exterior surfaces of composite box structure 30. A plurality of side stakes or support posts 56 are preferably attached to interior surface 55 of each side sheet 54. Support posts 56 project toward interior 32 of composite box structure 30. For some applications, isolators 60 formed from a strip of thermoplastic polymers such as polyvinyl chloride (PVC) insulating material may be attached to interior surface 57 of support posts 56.

Figure 12:
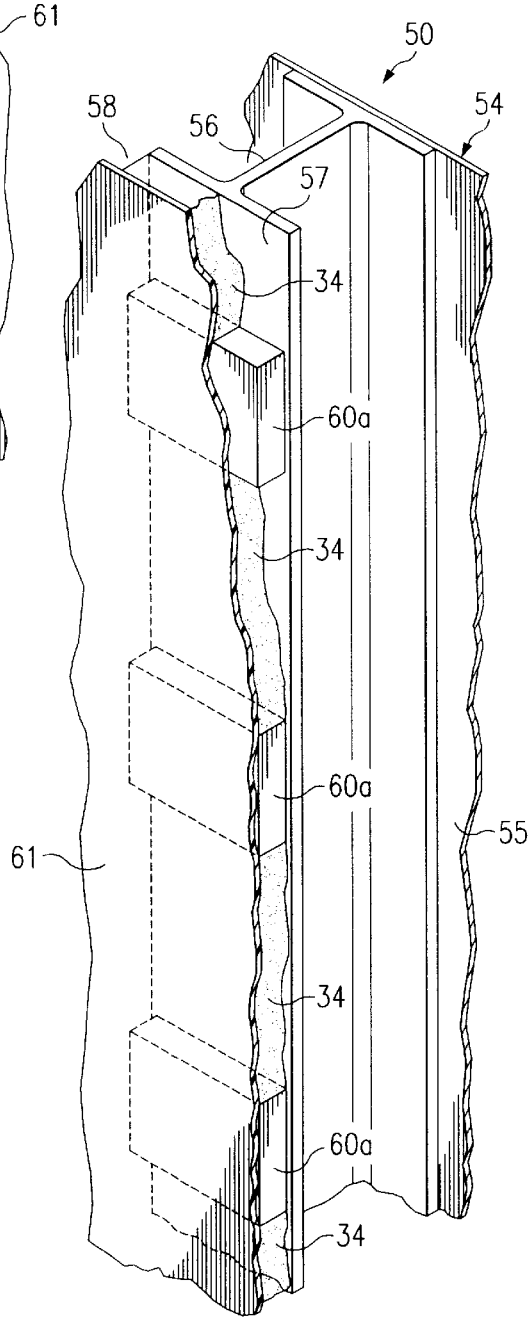
FIG. 12 is a schematic drawing in section with portions broken away showing components of a side wall assembly formed in accordance with teachings of the present invention.
Figure 13:
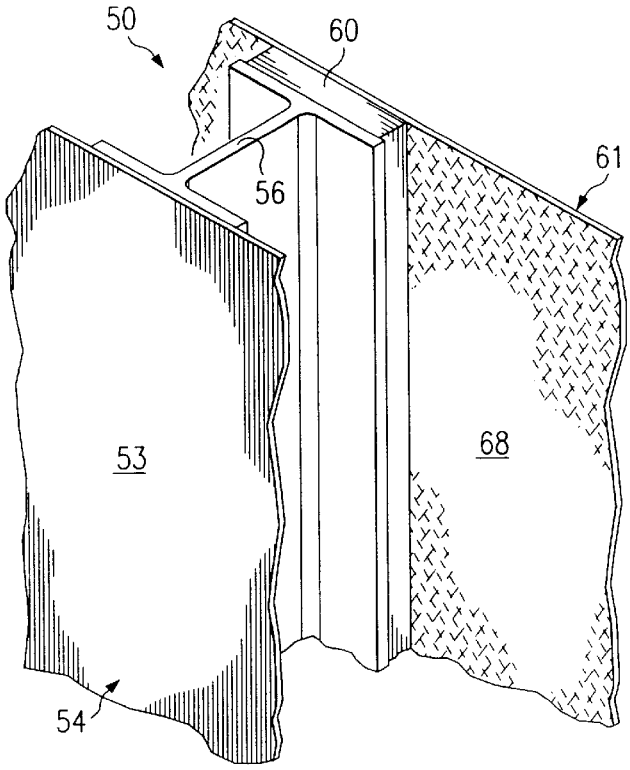
FIG. 13 is a schematic drawing in section with portions broken away showing a layer of scrim material attached with a layer of fiber reinforced plastic to enhance bonding with foam insulation.

For other applications such as shown in FIG. 12, respective isolators 60*a* formed from blocks of PVC material and alternating blocks 34 of insulating foam may be disposed on respective interior surfaces 57 of support posts 56. Isolators 60*a* may be formed from the same types of material used to form isolator 60. Blocks 34 of insulating foam may be formed from the same types of materials used to form foam insulation 58. Alternating blocks 34 of insulating foam with isolators 60*a* often results in reduced heat transfer between associated support posts 56 and interior 32 of composite box structure 30. Various thermoplastic polymers and other types of insulating material may be attached to interior surface 57 of support posts 56. The present invention is not limited to use of PVC strips or PVC blocks.

First layer 61 of polymeric material may then be placed adjacent to isolators 60 or isolators 60*a*. Foam insulation 58 is preferably disposed between adjacent sides posts 56 and bonded with interior surface 55 of side sheets 54, the interior surface of first layer 61 and adjacent portions of support posts 56. For some applications a layer of scrim 68 (see FIG. 13) may be attached to the interior surface of first layer 61 to enhance bonding with foam insulation 58. Scrim layer 68 may be a nonwoven fabric or any other suitable material for bonding foam insulation 58.

Second layer 62 of polymeric material may be attached to first layer 61. Various types of adhesives and mechanical fasteners may be used. For some applications, second layer 62 may be nailed to first layer 61 by nails (not expressly shown) inserted into isolators 60 or isolators 60*a*. Second layer 62 preferably includes a corrugated cross section which provides desired airflow paths 63 when lading is disposed adjacent to the side wall assembly 50 or 52. The corrugated cross section of second layer 62 provides airflow paths 63 which form portions of airflow management system 300.

First layer 61 and second layer 62 are preferably formed from tough, light weight, relatively rigid material having high impact resistance. First layer 61 and second layer 62 cooperate with each other to form a liner for composite box structure 30. For some applications layer 61 may be eliminated and the thickness of layer 62 increased. Also, layer 62 may not be used for some railway cars. First layer 61 and second layer 62 may be formed from Bulitex material available from U.S. Liner Company, a division of American Made, Inc. Bulitex material may be generally described as a ballistic grade composite scuff and wall liner.

Various types of ballistic resistant fabric may also be satisfactorily used to provide a liner for a composite box structure in accordance with teachings of the present invention. Ballistic resistant fabrics are often formed with multiple layers of woven or knitted fibers. The fibers are preferably impregnated with low modulus elastomeric material as compared to the fibers which preferably have a high modulus. U.S. Pat. No. 5,677,029 entitled "Ballistic Resistant Fabric Articles" and assigned to Allied Signal shows one example of a ballistic resistant fabric.

For one application side sheets 54 may be formed from twelve (12) gauge steel. Support posts 56 may be three (3) inch I-beams. Isolators 60*a* may have dimensions of approximately two (2) inches by two (2) inches by three-fourths (¾) of an inch. Foam insulation 58 may have a thickness of approximately four (4) inches. First layer 61 may be formed from Bulitex material having a thickness of approximately 0.06 inches. Second layer 62 may be formed from Bulitex material having a thickness of approximately 0.04 inches. The width of corrugations formed in second layer 62 may be between approximately four (4) and five (5) inches. The corrugations preferably form airflow gaps 63 of approximately one-half (½) inch relative to first layer 61.

For embodiments of the present invention as shown in FIGS. 1A–19 portions of railway car underframe 200 may be manufactured and assembled using conventional railcar manufacturing procedures and techniques. Railway car underframe 200 includes a pair of railway car trucks 202 and 204 located proximate each end of railway car underframe 200. Standard railcar couplings 210 are also provided at each end of railway car underframe 200. Each coupling 210 preferably includes respective end of car cushioning unit 212 disposed at each end of center sill 214. See FIGS. 3 and 4.

Figure 3:
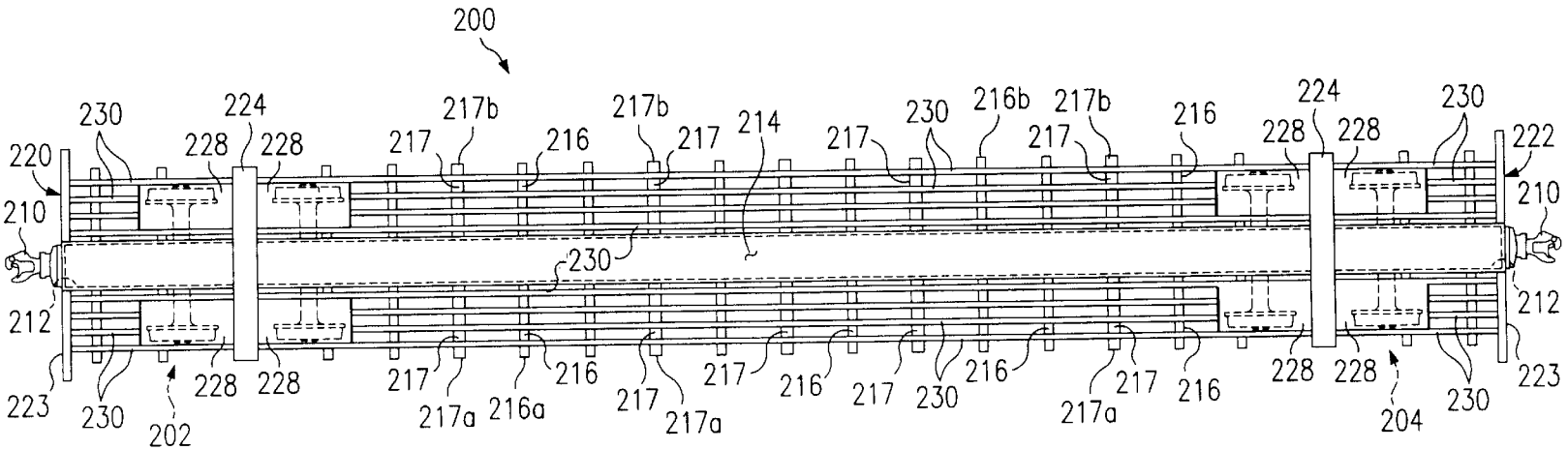
FIG. 3 is a schematic drawing showing a plan view with portions broken away of a railway car underframe incorporating teachings of the present invention.

Railway car underframe 200 includes a pair of body bolsters 224 and 226 with each body bolster 224 and 226 disposed over respective railway trucks 202 and 204. Body bolsters 224 and 226 extend laterally from center sill 214. For the embodiment as shown in FIG. 3, each body bolster 224 and 226 includes cover plates 228 which extend over the wheels of railway car trucks 202 and 204. Cover plates 228 reinforce openings created in railway car underframe 200 to provide required wheel clearance for railway car trucks 202 and 204.

Figure 4:
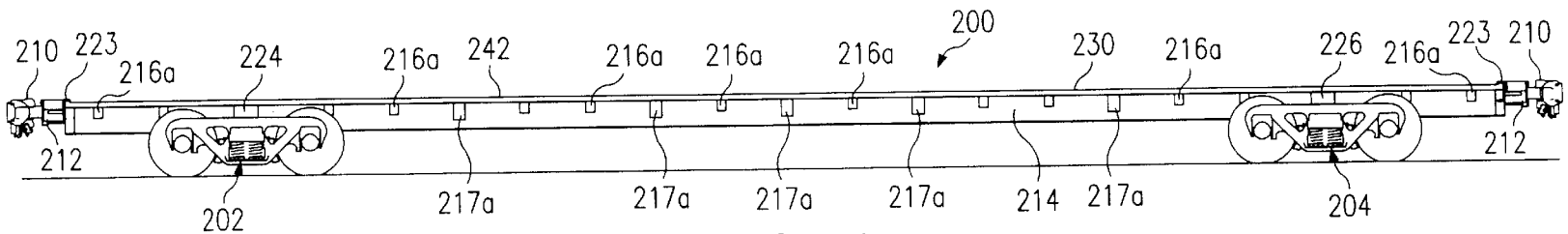
FIG. 4 is a schematic drawing showing a side view of the railway car underframe of FIG. 3.

As shown in FIGS. 3 and 4, railway car underframe 200 includes center sill 214, longitudinal stringers 230, cross bearers 217, cross ties 216 and body bolsters 224 and 226 arranged in a generally rectangular configuration. Cross bearers 217 and cross ties 216 are attached to and extend laterally from center sill 214.

Figure 5:
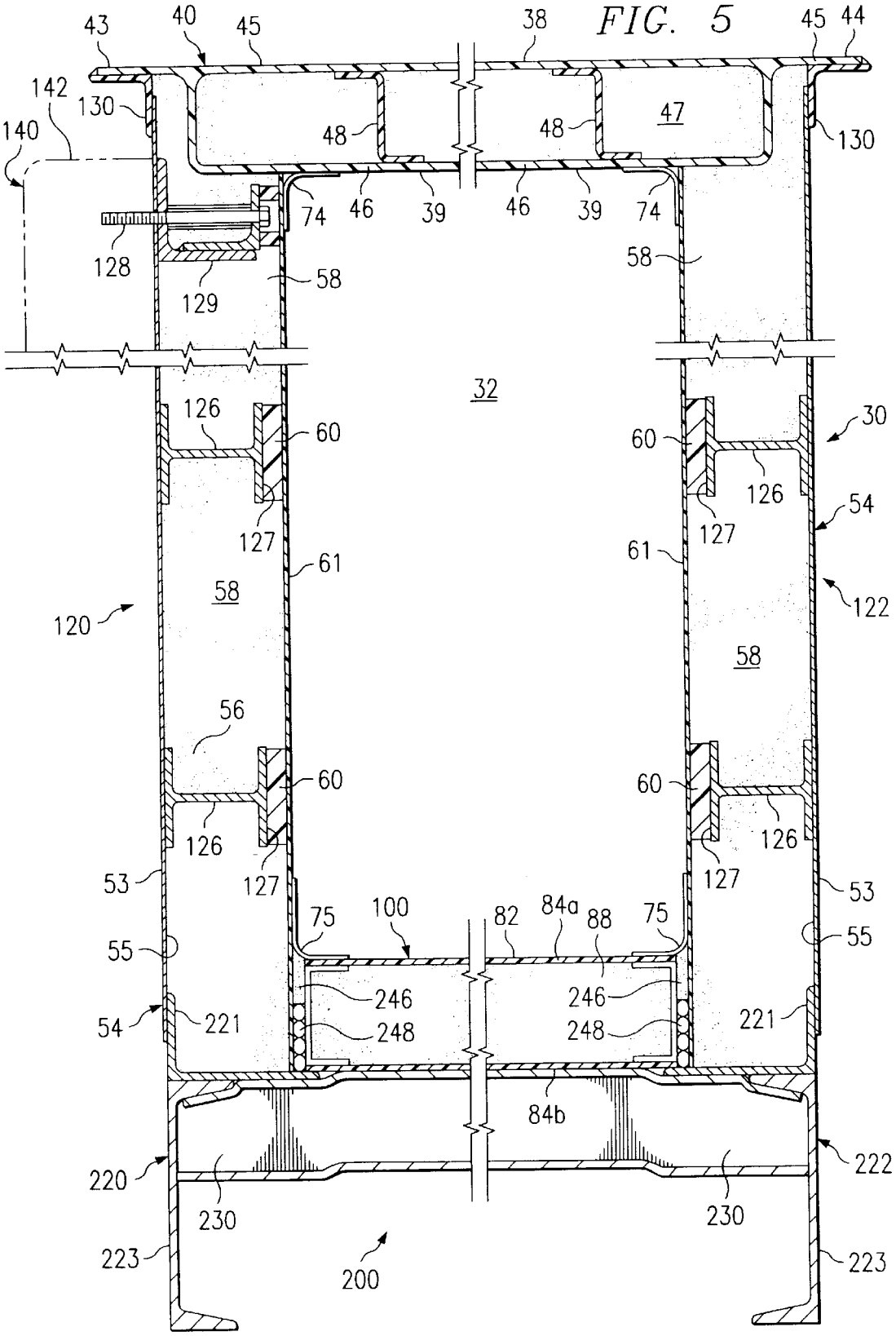
FIG. 5 is a schematic drawing in section with portions broken away showing selected features of a composite box structure incorporating teachings of the present invention mounted on a railway car underframe.
Figure 6:
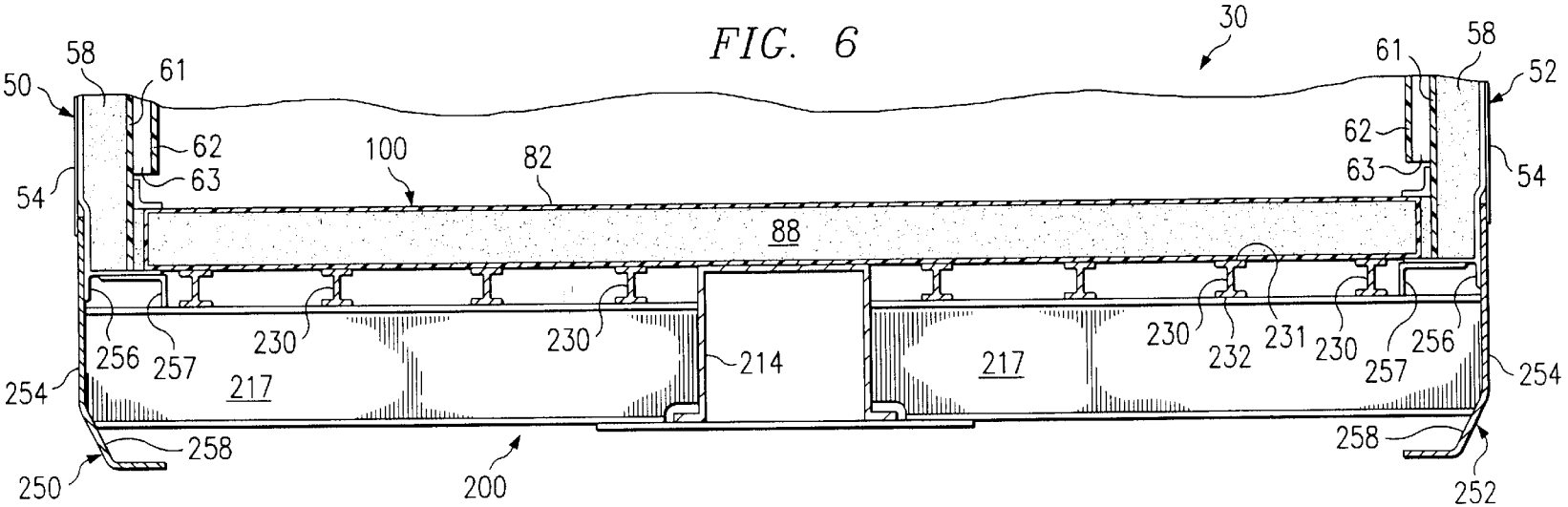
FIG. 6 is a schematic drawing in section with portions broken away showing a pair of side wall assemblies and a floor assembly mounted on a railway car underframe incorporating teachings of the present invention.
Figure 8:
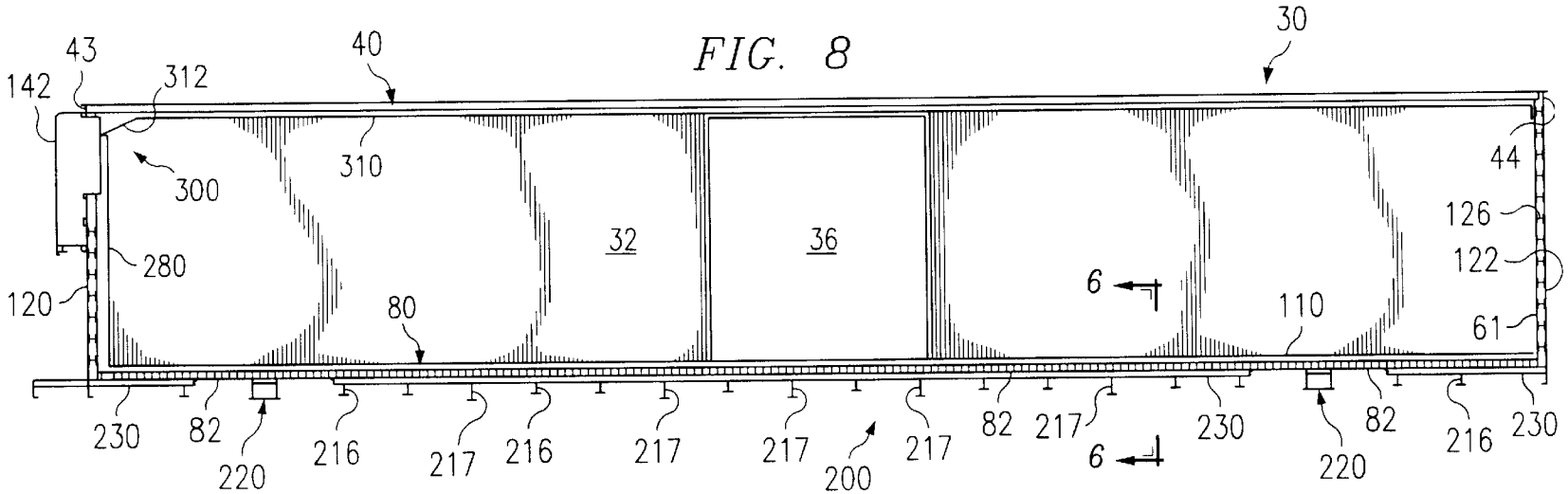
FIG. 8 is a schematic drawing in section with portions broken away showing selected features of a composite box structure and an associated railway car underframe incorporating teachings of the present invention.

Railway car underframe 200 preferably includes a plurality of longitudinal stringers 230 which extend approximately the full length of railway car underframe 200. Longitudinal stringers 230 may be disposed on cross bearers 217 and cross ties 216 and extending parallel with center sill 214. FIGS. 5 and 6 show portions of floor assembly 80 disposed on longitudinal stringers 230 and respective portions of end sill assemblies 220 and 222 and respective portions of side sill assemblies 250 and 252. The number of cross bearers 217, cross ties 216 and longitudinal stringers may be varied depending upon the desired load carrying characteristics for the resulting railway car 20.

Each longitudinal stringer 230 preferably includes first surface 231 and second surface 232 which rests upon cross bearers 217 and cross ties 216. See FIG. 6. A selected portion of floor assembly 80 may be preferably adhesively bonded or securely attached with portions of first surfaces 231 of longitudinal stringers 230. Other portions of floor assembly 80 may expand and contract relative to longitudinal stringers 230.

Side wall assemblies 50 and 52 are preferably fabricated with respective side sill assemblies 250 and 252 formed as integral components thereof. End wall assemblies 120 and 122 may also be formed with all or at least portions of respective end sill assemblies 220 and 222 formed as integral components thereof.

For the embodiment of the present invention as shown in FIG. 5, end sill assemblies 220 and 222 include respective angles 221 and respective C-shaped channels 223. For this embodiment of the present invention respective angles 221 on an integral portion of respective end wall assemblies 120 and 122. Respective angles 221 may be securely attached with adjacent metal sheets 54 using conventional welding techniques and bonded with foam insulation 58. The length of each C-shaped channel 223 approximately equals the width of railway car underframe 200 and the exterior width of composite box structure 30. The end of each longitudinal stringer 230 is preferably formed to receive portions of respective C-shaped channels 223 and portions of respective angles 221. Various welding techniques and/or mechanical fasteners (not expressly shown) may be used to couple metal sheets 54 with respective angles 221, angles 221 with respective C-shaped channels 222 and end sill assemblies 220 and 222 with respective ends of longitudinal stringers 230. For some applications end wall assemblies 120 and 122 may be formed with all components of an associated end sill assembly attached thereto.

Figure 7:
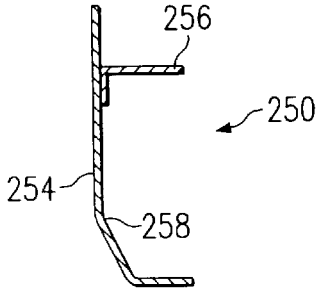
FIG. 7 is a schematic drawing in section with portions broken away showing a side sill assembly incorporating teachings of the present invention.

Side sill assemblies 250 and 252 will preferably have substantially the same configuration and dimensions. As shown in FIGS. 6 and 7 side sill assembly 250 has a generally J shaped cross section. The configuration of exterior surface 254 of side sill assemblies 250 and 252 preferably corresponds with the dimensions of plate F. Respective support members 256 may be attached to interior surface 258 of each side sill assembly 250 and 252. Support member 256 may extend along substantially the full length of the respective side sill assembly 250 and 252. Respective support members 257 may also be disposed between each support member 256 and respective cross bearers 217 and cross ties 216. For the embodiment of the present invention as shown in FIGS. 6 and 7 support members 256 and 257 may be formed from metal angles having desired dimensions compatible with railway car underframe 200 and floor assembly 80.

Support members 257 may be welded with or otherwise securely attached with adjacent portions of the associated cross bearers 217 or cross ties 216. For some applications, support members 257 may have a length of approximately six (6) inches. Adjacent to each door opening 36 formed within respective side wall assemblies 50 and 52, support members 257 may have a length of approximately fourteen (14) feet (not expressly shown). Support members 257 are preferably welded to or permanently attached with cross bearer 217 and/or cross tie 216 located adjacent to respective openings 36 to provide additional strength during loading and unloading of lading carried within composite box structure 30. Supporting members 256 and 257 cooperate with longitudinal stringers 230 to provide support for primary floor 100.

End wall assemblies 120 and 122 may be formed using similar materials and techniques as previously described with respect to side wall assembly 50. For side wall assembly 50, support posts 56 extend generally vertically between side sill assembly 250 and top chord 64 (see FIGS. 9 and 18). End wall assemblies 120 and 122 may also be formed with end beams 126 having an I-beam configuration similar to support posts 56. However, end beams 126 disposed within end wall assemblies 120 and 122 extend generally horizontally with respect to each other and railway car underframe 200. See FIGS. 5 and 19.

End beams 126 are respectively attached with metal sheets 54. Metal sheets 54 of end wall assemblies 120 and 122 may also be referred to as "end sheets" or "side sheets." Respective isolators 60 or alternating isolators 60*a* and blocks 34 of insulating foam may be attached to interior surface or first surface 127 of each support beam 126. Foam insulation 58 may be disposed between and bonded with adjacent portions of end beams 126, interior surface 55 of metal sheets 54 and adjacent portions of first layer 61.

For one embodiment end wall assembly 120 is preferably mounted on the first end of railway car underframe 200 with angle 221 disposed on and attached to respective C-shaped channel 223. In a similar manner, end wall assembly 122 is preferably mounted on the second end of railway car underframe 200 with respective angle 221 disposed on and attached to respective C-shaped angle 222. Various types of mechanical fasteners and/or welds may be formed between angles 222 and respective longitudinal stringers 230 and C-shaped channels 223.

As previously noted, roof assembly 40, side wall assemblies 50 and 52, floor assembly 80, and end wall assemblies 120 and 122 are preferably fabricated as individual components. For some applications these components may be fabricated at the same facility. For other applications one or more components may be fabricated at a remotely located facility. Each component may be attached to railway car underframe 200 in accordance with teachings of the present invention.

For one embodiment side wall assembly 50 is preferably mounted on one longitudinal edge of railway car underframe 200 with side sill assembly or bottom chord 250 disposed adjacent to ends 217*a* of cross bearer 217 and ends 216*b* of cross tie 216. In a similar manner side wall assembly 52 is preferably mounted on an opposite longitudinal edge of railway car underframe 200 with side sill assembly or bottom chord 252 disposed adjacent to ends 217*b* of cross bearer 217 and ends 216*b* of cross tie 216. Various types of mechanical fasteners and/or welds may be formed between side sill assemblies 250 and 252 and the respective ends 216*a*, 216*b*, 217*a* and 217*b*. For some applications Huck type mechanical fasteners are preferably used to attach side sill assemblies 250 and 252 with the respective cross bearer 217 and/or cross tie 216.

Figures 16, 17:
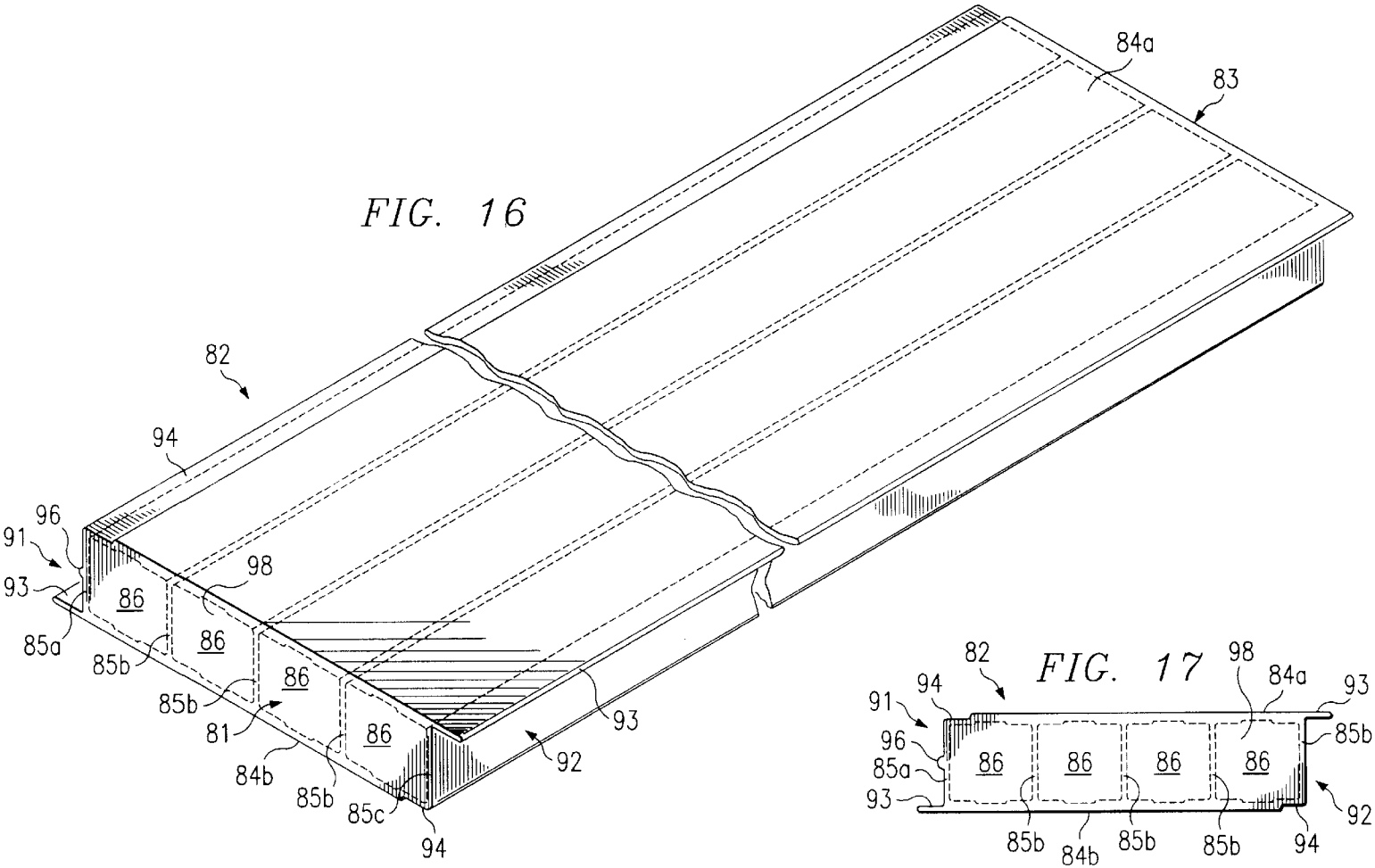
FIG. 16 is a schematic drawing showing an isometric view with portions broken away of a panel which may be used to form a portion of a floor assembly such as shown in FIGS. 5 and 6.
FIG. 17 is a schematic drawing showing an end view of the panel of FIG. 16.

For some applications a plurality of panels 82 are preferably bonded with each other to form primary floor 100 having a generally rectangular configuration corresponding with the desired interior length and width for composite box structure 30. The length of each panel 82 preferably corresponds with the desired interior width of composite box structure 30. See FIG. 6. U.S. Pat. No. 5,716,487 entitled "Pultrusion Apparatus" assigned to Creative Pultrusions, Inc. describes one example of equipment and procedures which may be used to form panels 82. One example of a panel satisfactory for use in forming primary floor 100 is shown in FIGS. 16 and 17.

After the desired number of panels 82 have been bonded with each other, the resulting primary floor 100 may be lowered from above or through door openings 36 in side wall assemblies 50 and 52 until primary floor 100 engages longitudinal stringer 230 and respective support members 256 of side sill assemblies 250 and 252. See FIG. 6. Roof assembly 40 may be then mounted on and attached with side wall assemblies 50 and 52 and end wall assemblies 120 and 122. See FIGS. 5 and 9.

Figure 9:
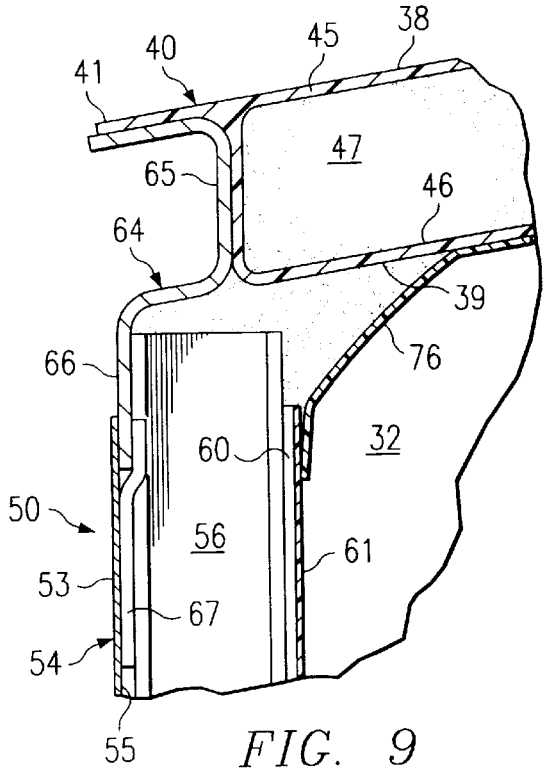
FIG. 9 is a schematic drawing in section showing one example of a flexible joint or flexible connection formed between a roof assembly and a side wall assembly incorporating teachings of the present invention.
Figure 10:
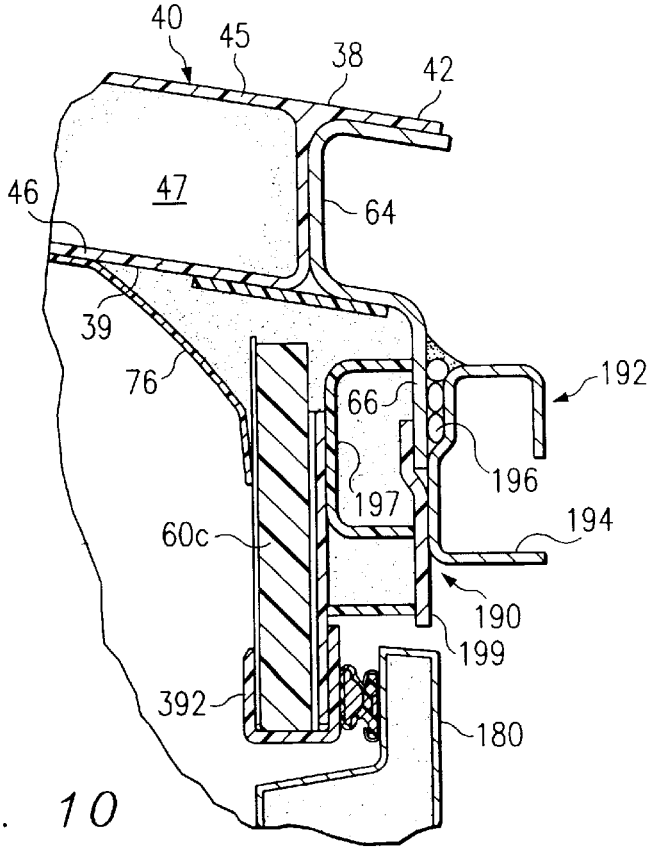
FIG. 10 is a schematic drawing in section with portions broken away showing portions of a door frame assembly disposed within a composite box structure incorporating teachings of the present invention.
Figure 11:
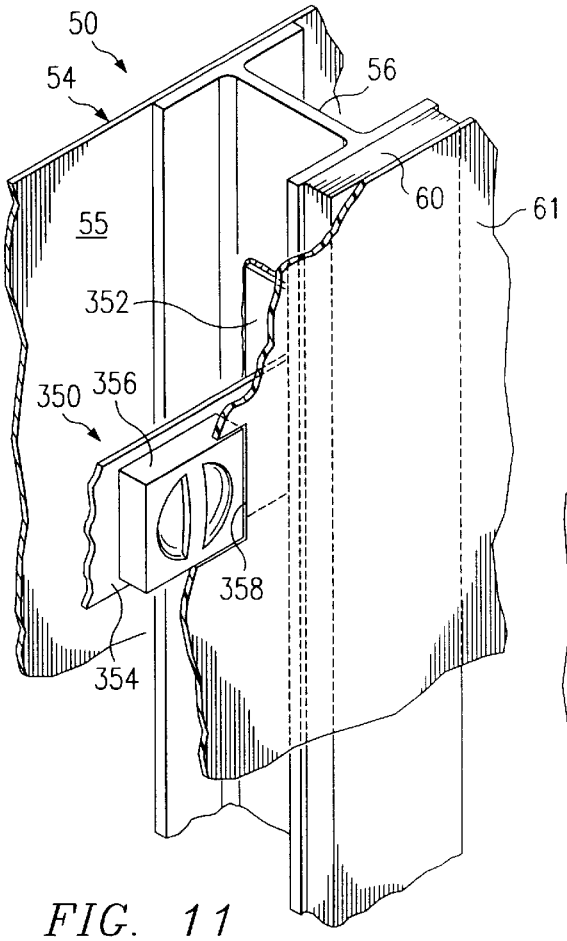
FIG. 11 is a schematic drawing showing an isometric view with portions broken away of one example of a tie down mechanism mounted in a side wall assembly incorporating teachings of the present invention.
Figure 18:
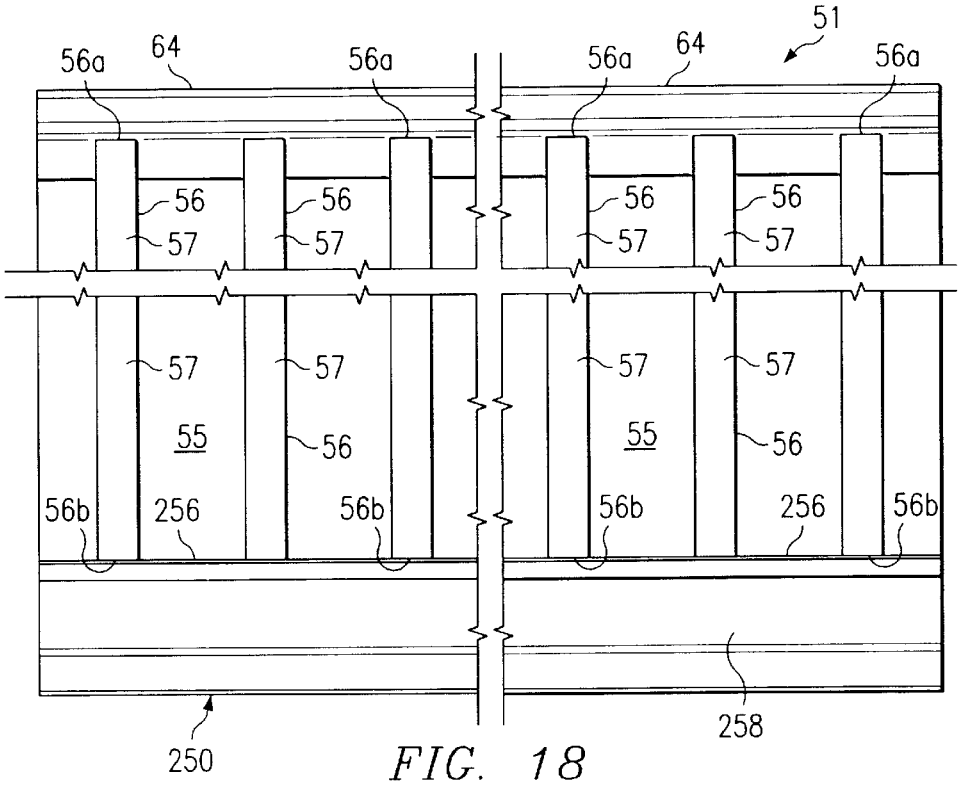
FIG. 18 is a schematic drawing in elevation with portions broken away showing a side wall frame assembly incorporating teachings of the present invention.

As shown in FIGS. 9, 10 and 18, side wall assemblies 50 and 52 preferably include respective top chords 64. Top chords 64 extend longitudinally along the respective upper edge of side wall assemblies 50 and 52. Top chords 64 may sometimes be referred to as "top plates". Each top chord 64 has a cross section defined by a generally "C-shaped" portion 65 with leg 66 extending therefrom. The upper portion of adjacent side sheets 54 may be attached with leg portion 66 of each of the associated top chord 64. One or more strips of metal 67 may be attached with both interior surface 55 of the adjacent metal sheets 54 and the interior surface of leg 66. See FIG. 9. Various techniques such as welding and/or mechanical fasteners may be used to attached metal sheet 54 with metal strips 67 and adjacent portions of top chord 64.

Roof assembly 40 may be formed with a generally elongated, rectangular configuration. The length and width of roof assembly 40 corresponds generally with the desired length and width of composite box structure 30. Roof assembly 40 includes first longitudinal edge 41 and second longitudinal edge 42 spaced from each other and extending generally parallel with each other from first lateral edge 43 to second lateral edge 44. Roof assembly 40 may have a generally arcuate configuration extending from first longitudinal edge 41 to second longitudinal edge 42. See FIGS. 9 and 10. First longitudinal edge 41 and second longitudinal edge 42 are preferably mounted on and attached with adjacent portions of respective side wall assemblies 50 and 52. See FIGS. 9 and 10. Lateral edges 43 and 44 are preferably mounted on and attached with respective end wall assemblies 120 and 122. See FIG. 5.

Various types of composite materials and insulating materials may be satisfactorily used to form roof assembly 40. For some applications, roof assembly 40 may be formed from one or more FRP layers 45 and 46. Each FRP layer may be formed from multiple panels or sheets of FRP. As shown in FIGS. 9 and 10 FRP layer 45 provides outer surface 38 of roof assembly 40. FRP layer 46 provides interior surface 39 of roof assembly 40. FRP layers 45 and 46 may be bonded with each other to encapsulate insulating layer 47 therebetween. For some applications insulating layer 47 may be formed from the same materials used to form foam insulation 58. However, any material having desired thermal insulating characteristics may be satisfactorily used to form insulating layer 47. Stiffeners 48 are preferably disposed between FRP layer 45 and FRP layer 46.

Each end wall assembly 120 and 122 preferably includes a respective top chord or top plate 130 attached with upper portions of adjacent metal sheets 54. Roof assembly 40 may be attached to and/or bonded with respective top chords 64 of side wall assemblies 50, 52 and top chords or top plates 130 of end wall assemblies 120 and 122. As shown in FIGS. 9 and 10, insulating foam is preferably disposed within the joint or flexible connection formed between roof assembly 40 and adjacent portions of side wall assembly 50. An end closure may also be disposed between top plate 130 and adjacent portions of roof assembly 40 having a generally arcuate shape. Trim molding 76 is preferably bonded with adjacent portions of roof assembly 40 and side wall assemblies 50 and 52.

Each side wall assembly 50 and 52 preferably includes respective openings 36 with door assembly 180 attached thereto and slidably mounted thereon. See FIGS. 1A, 8, 10 and 15. Each door assembly 180 has a first position blocking respective opening 36 to form a barrier between interior 32 and the exterior of composite box structure 30. Each door assembly 180 also has a second position which allows access to interior 32 of composite box structure 30 through respective opening 36. Various types of doors may be satisfactory used with composite box structure 30, including doors fabricated from steel and/or wood, or doors fabricated from composite materials. Door assembly 180 is preferably formed from materials with thermal insulation characteristics corresponding with the associated side wall assembly 50 and 52. Each door assembly 180 is preferably mounted on respective side wall assemblies 50 and 52 using conventional hardware such as operating pipes, operating mechanisms, rollers, locking bars, gears and cams associated with conventional railway boxcars. Such items may be obtained from several vendors including YSD Industries, Inc. (Youngstown Steel Door), and Pennsylvania Railcar.

Figure 15:
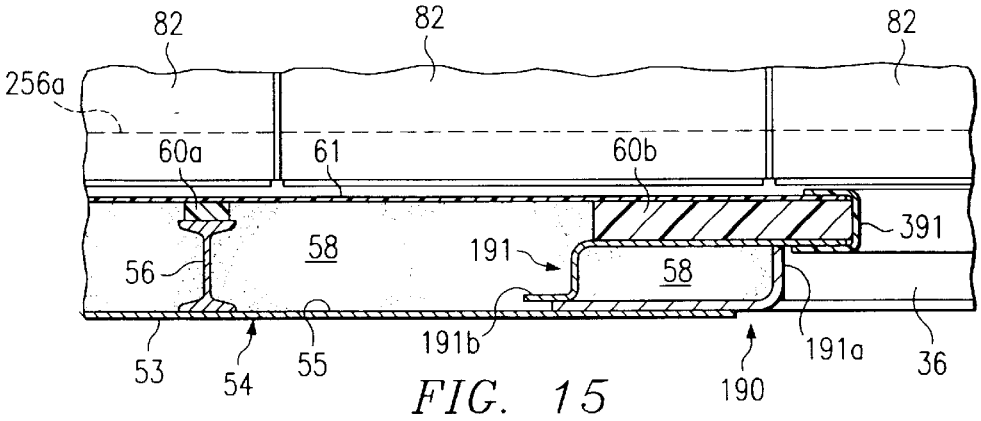
FIG. 15 is a schematic drawing in section with portions broken away showing a door post disposed in a composite box structure incorporating teachings of the present invention.

Portions of door frame assembly 190, which may be satisfactorily used with door assembly 180, are shown in FIGS. 10 and 15. Typically, each door assembly 180 will be slidably mounted on upper track 194 and lower track 196 which are attached adjacent to respective openings 36. See FIG. 1A. Door frame assembly 190 may include upper track 194, portions of top chord 64, C-shaped channel 197, plate 199 and other plates shown in FIG. 10. Upper track 194 is shown attached with adjacent portions of top chord 64. One or more layers 196 of sealing material may be disposed between upper track 194 and leg 66 of top chord 64. Upper track 194 is shown attached to leg 66 of top chord 64 by C-shaped channel 197 and plate 199. Various welding techniques and/or mechanical fasteners may be used as desired.

As shown in FIGS. 10 and 15, door frame assembly 190 is preferably attached to the perimeter of each opening 36 formed in respective side wall assemblies 50 and 52. Each door frame assembly 190 may include a pair of vertical door post assemblies 191 and door header or door retainer 192. Upper door track 194, lower door track 196, and a threshold (not expressly shown) may also be installed adjacent to each door frame assembly 190. Vertical door post assemblies 191 are attached with an secured to adjacent portions of side wall assemblies 50 and 52. Door header 192 is disposed between and attached to vertical door post assemblies 191 at the top of each opening 36.

For the embodiment of the present invention as shown in FIG. 15, each door post assembly 191 may be formed from metal angles 191*a* and 191*b*. Metal angles 191*a* and 191*b* may have various configurations other than those shown in FIG. 15. Foam insulation 58 is preferably disposed within a void space formed between angles 191*a* and 191*b*. Angle 191*a* may be welded with or otherwise securely attached to adjacent portions of side sill assembly 250, side sheet 54 and top chord 64. Metal angle 191*b* may be attached with metal angle 191*a* and adjacent portions of side sill assembly 250. Respective isolators 60*b* are preferably attached with the interior surface of each support post 191 opposite from adjacent metal sheet 54. Isolators 60*b* may be formed from the same materials as previously described with respect to isolator 60 and 60*a*.

Respective strips 391 of fiber reinforced plastic may be attached over adjacent portions of first layer 61, isolators 60*b* and portions of door frame assembly 190 which extend into the associated opening 36. Strips 391 of fiber reinforced plastic may be formed using pultrusion techniques with a cross section corresponding approximately with the associated first layer 61, isolator 60*b* and portions of door frame assembly 190. For some applications, strips 391 of fiber reinforced plastic 391 may be formed with a snug or snap tight fit such that strips 391 may form an interference fit with adjacent portions of the associated isolator 60*b*. Dotted line 256*a* represents the end of support member 256 extending from the associated side sill assembly 250.

Isolator 60*c* is preferably disposed adjacent to the interior surface of door header 192 extending between associated door post assemblies 191. See FIG. 10. Isolator 60*c* may be formed from the same materials as previously described with respect to isolators 60 and 60*a*. A strip of fiber reinforced plastic 392 may be attached over adjacent portions of first layer 61, isolator 60*c* and portions of door frame assembly 190. which projects into the associated opening 36. Strip 392 of fiber reinforced plastic may be formed similar to previously described strip 391 of fiber reinforced plastic.

When the associated door assembly 180 is in its first or closed position, portions of door assembly 180 will contact adjacent portions of strips 391 and 392. The configuration and dimensions of strips of which are mounted on a door frame assembly in accordance with teachings of the present invention may vary substantially as compared with strips 391 and 392 of fiber reinforced plastic as shown in FIGS. 10 and 15.

As shown in FIGS. 10 and 15 portions of each frame assembly 190 are preferably offset from the exterior of composite box structure 30 to receive respective door assemblies 180. A corresponding offset (not expressly shown) may also be formed in adjacent portions of thresholds (not expressly shown) at respective openings 36. The resulting offsets at each opening 36 accommodate door frame assembly 190 and particularly door post assemblies 191 to allow the associated door assembly 180 and its operating mechanism to fit within the desired AAR clearance envelope.

Metal plates (not expressly shown) and/or an elastomeric threshold may be disposed within the lower portion of each opening 36 adjacent to floor assembly 80. The metal plates and/or threshold may be formed from steel alloys, aluminum alloys, ceramic materials and/or composites of these materials.

An elastomeric gasket (see FIG. 10) may be formed on the interior of each door assembly 180 adjacent to the perimeter of the respective door assembly 180. The elastomeric gasket is preferably formed to contact adjacent portions of door frame assembly 190 when the respective door 180 is in its first position. The elastomeric gasket and portions of door frame assembly 190 including strips 391 and 392 cooperate with each other to minimize heat transfer between the interior and the exterior of composite box structure 30, when the respective door 180 is in its first, closed position.

Door stops (not expressly shown) may be mounted on the exterior of each side wall assembly 50 and 52 to limit movement of the associated door assembly 180 from its first position to its second position.

Various types of mechanical tie-down connections may be provided within interior 32 of composite box structure 30. One example of a tie-down connection is represented as tie-down assembly 350 shown in FIG. 11. The components of tie-down assembly 350 include a generally L-shaped metal angle having a first portion 352 and a second portion 354. First portion 352 may be welded to the web of the associated support post 56. Tie-down block 356 is preferably welded to second portion 354. An appropriate opening 358 may be formed in first layer and second layer of fiber reinforced plastic 61 and 62 to provide access to tie-down block 356.

Figure 14:
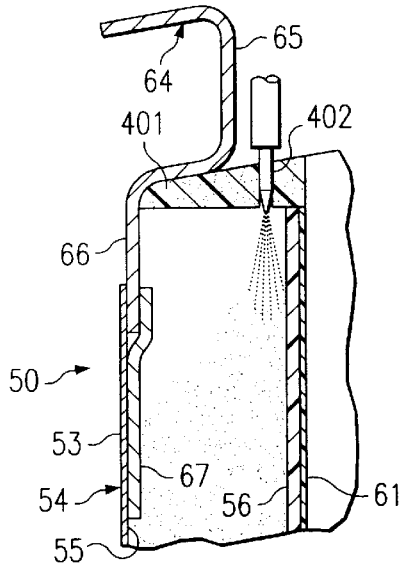
FIG. 14 is a schematic drawing in section with portions broken away showing injection of liquid insulating foam into a side wall assembly incorporating teachings of the present invention.

A portion of side wall assembly 50 is shown in FIG. 14 after side wall frame assembly 51 has been assembled (see FIG. 18) and layer 61 has been disposed on support post 56 opposite from metal seats 54. Isolators 60 or 60*a* (not shown in FIG. 14) will preferably also be disposed between support post 56 and first layer 61 of fiber reinforced plastic. A plurality of injection blocks 401 may be disposed between portions of top chord 64 and adjacent portions of support posts 56. A plurality of openings 402 are preferably formed within each injection block 401 to allow injecting liquid insulating foam into the associated void spaces defined in part by interior surface 55 of metal sheet 54, adjacent portions of support posts 56 and the interior surface of first layer 61. Injection block 401 may be formed from substantially the same material as the liquid insulating foam which will be injected through openings 402. After the liquid insulating foam is solidified, injection blocks 401 form an integral component of the associated foam insulation 58.

Side wall frame assembly 51 with first layer 61 disposed on isolators 60*a*, support posts 56 and side sheets 54 may be placed within a foam press (not expressly shown) to maintain desired temperatures for forming foam insulation 58 from the liquid insulating foam injected through openings 402. Forming solid foam insulation 58 in accordance with teachings of the present invention results in foam insulation 58 bonding with interior surface 55 of metal sheets 54, adjacent portions of support post 56 and the interior surface of first layer 61. For some applications side wall assemblies 50 and 52 may be disposed at an angle between approximately eight (8) degrees and twelve (12) degrees to allow the desired formation of foam insulation 58 and associated adhesive bonds. For some applications side wall assemblies 50 and 52 may be disposed at an angle of approximately ten (10) degrees during injection of liquid insulating foam and the formation of solid foam insulation 58. The angle may be varied depending upon the configuration of the respective side wall assembly or end wall assembly and the type of insulating foam.

Various types of foam presses (not expressly shown) may be satisfactorily used to form side wall assemblies and end wall assemblies in accordance with teachings of the present invention. Foam presses are available from various manufacturers including CON-TEK Machine, Inc., located at 3575 Hoffman Road East, St. Paul, Minn..

Temperature control system 140 preferably includes refrigeration unit or cooling unit 142 and airflow management system 300 which provides uniform, constant airflow around and through lading carried within composite box structure 30. For some applications such as transporting products in sub-zero, ambient temperature, winter environments temperature control system 140 may include a heater. Refrigeration unit 142 may be a self-contained refrigeration unit including a compressor (not expressly shown), condenser (not expressly shown), airflow blowers (not expressly shown), an external fuel tank 219 and a diesel engine (not expressly shown). For some applications, refrigeration unit 142 may provide airflow in the range of 3200 CFM. Self-contained refrigeration unit 142 provides the advantage of easier and faster maintenance as compared to conventional refrigerated boxcars with similar performance characteristics. As a result, temperature control system 140 generally lowers maintenance time and costs and increases the amount of time that temperature controlled railway car 20 remains in service between repairs.

Refrigeration unit 142 may be a programmable unit able to control and maintain desired temperatures within composite box structure 30. Refrigeration unit 142 may include a keypad for inputting data for desired system performance and a microprocessor to control and monitor the functions and performance of refrigeration unit 142 and temperature control system 140. Refrigeration unit 142 may also include a satellite monitoring and control system (not expressly shown) and/or cellular technology to transmit to remote locations information such as the performance and location of refrigeration unit 142 or the temperature inside composite box structure 30. Various types of refrigeration systems are commercially available from companies such as Thermo King and Carrier. Such units are frequently used in motor carrier trailers and other large containers.

As shown in FIGS. 1A, 1B and 5 refrigeration unit 142 may be mounted on end wall assembly 120 of the composite box structure 30. Refrigeration unit 142 may be mounted on the exterior of end wall assembly 120 using bolts 128 and associated supports 130 disposed within end wall assembly 120. The number of mounted bolts may be varied depending on the size and weight of associated refrigeration unit 142.

End platform system 260 may be coupled to railway car underframe 200 to provide access to refrigeration unit 142. Refrigeration unit 142 may include an external fuel tank 219 located proximate to refrigeration unit 142. This provides the benefit of convenient access to both the fuel tank and refrigeration unit 142.

As shown in FIGS. 16 and 17, each pultruded panel 82 may have a generally rectangular configuration defined in part by first end 81 and second end 83 with first longitudinal edge profile 91 and second longitudinal edge profile 92 extending between first end 81 and second end 83. Longitudinal edge profiles 91 and 92 are spaced from each other.

Pultruded panel 82 may include first layer 84*a* and second layer 84*b* with a plurality of webs or dividers 85 disposed therebetween. Webs 85*a* and 85*c* form a portion of respective first longitudinal edge profile 91 and second longitudinal edge profile 92. Webs 85 may have substantially the same dimensions. Void spaces or cavities 86 formed in part by webs 85 may be filled with insulating foam (not expressly shown) having good thermal insulation characteristics. The use of insulating foam substantially reduces heat transfer through the resulting floor assembly 80.

The configuration of longitudinal edge profiles 91 and 92 are preferably selected to engage respective longitudinal edge profiles 91 and 92 of adjacent pultruded panels 82. Longitudinal edge profiles 91 and 92 may include respective flanges or lips 93 which extend laterally therefrom along approximately the full length of the associated pultruded panel 82. Longitudinal edge profile 91 preferably includes recess 94 formed in first layer 84*a*. Longitudinal edge profile 92 preferably includes respective recess 94 formed in second layer 84*b*. The dimensions and configurations of flanges 93 are selected to be compatible with recesses 94 of adjacent pultruded panels 82.

A projection such as bead 96 may be formed along longitudinal edge profile 91. When longitudinal edge profile 91 is engaged with an adjacent longitudinal edge profile 92, bead 96 creates a gap therebetween to allow application of an adhesive compound into the associated gap (not expressly shown). The adhesive compound (not expressly shown) may be used to bond or couple adjacent pultruded panels with each other. Cover plates or end caps 98 are shown placed over first end 81 and second end 83 to block access to associated void spaces 86. Cover plates 98 prevent moisture or other contaminates from contacting the associated insulating foam and reducing its thermal insulating characteristics. Also, any moisture or liquids which enter void spaces 86 may cause an undesired increase in the weight of the associated pultruded panel 82.

Portions of side wall frame assembly 51 satisfactory for use in forming a side wall assembly in accordance with teachings of the present invention are shown in FIG. 18. For purposes of describing various features of the present invention side wall frame assembly 51 will be described with respect to forming side wall assembly 50. However, side wall frame assembly 51 may be used to form side wall assembly 52. Side wall frame assembly 51 includes a plurality of support posts 56, side sill assembly 250, top chord 64. Side wall frame assembly 51 also includes portions of a door frame assembly 180.

First end 56*a* of each support post 56 is preferably attached to adjacent portions of top chord 64. Second end 56*b* of each support post 56 is preferably attached to adjacent portions of side sill assembly 250. Support posts 56, top chord 64 and side sill assembly 250 cooperate with each other to define a generally elongated, rectangular configuration corresponding with side wall assembly 50. A plurality of metal sheets 54 are preferably attached with the exterior surface of side wall frame assembly 51.

Figure 19:
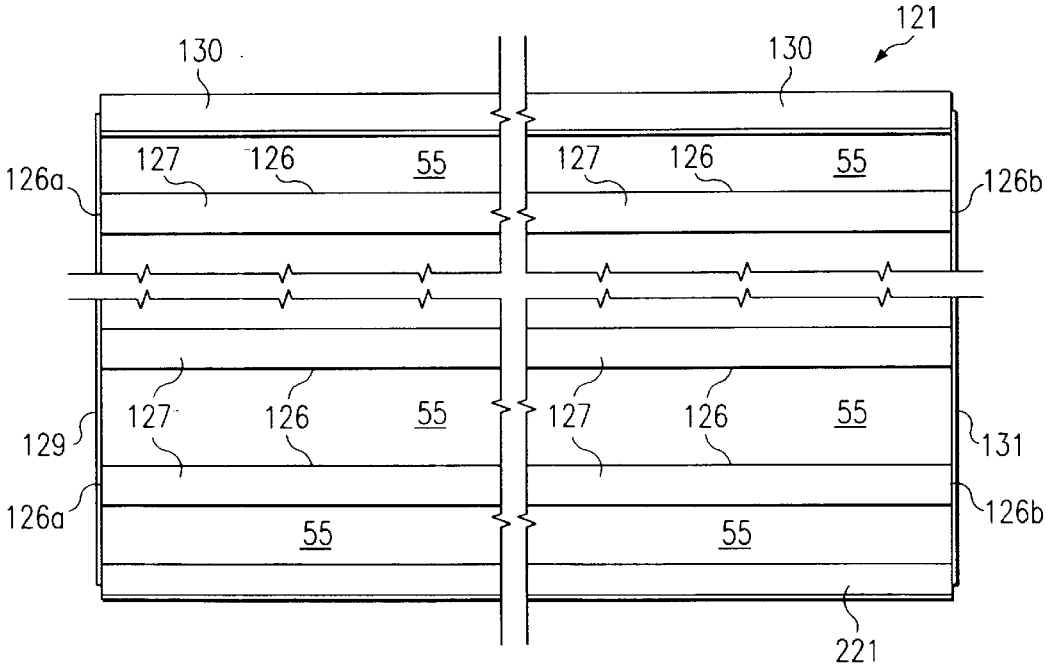
FIG. 19 is a schematic drawing in elevation with portions broken away showing an end wall frame assembly incorporating teachings of the present invention.

Portions of end wall frame assembly 121 formed in accordance of teachings of the present invention are shown in FIG. 19. For purposes of describing various features of the present invention, end wall frame assembly 121 will be described with respect to forming end wall assembly 120. However, end wall frame assembly 121 may be used to form end wall assembly 122. End wall frame assembly 121 includes top plate or top chord 130, angle 221 with edge plates 129 and 131 attached thereto and extending therebetween. Top plate 130, angle 221, and edge plates 129 and 131 form a generally rectangular configuration corresponding with end wall assembly 120 and 122.

A plurality of end beams 126 may also be attached with edge plates 129 and 131. First end 126*a* of each end beam 126 is preferably attached to edge plate 129. Second end 126*b* of each end beam 126 is preferably attached to respective portions of edge plate 131. End beams 126 are spaced from each other and extend generally parallel with top plate 130 and the associated angle 221. A plurality of metal sheets 54 is preferably attached with the exterior of end wall frame assembly 121.

For some applications a plurality of openings (not expressly shown) may be formed in edge plates 129 and/or 131. The openings may be used to inject liquid insulating foam into respective void spaces when end wall frame assembly 121 with isolators 60*a* and first layer 61 have been placed into a foam press. The number and size of the openings formed in edge plates 129 and/or 131 will depend upon the configuration and size of associated void spaces formed adjacent to end beams 126.

One temperature controlled railway car formed in accordance with teachings of the present invention has the following features:

286,000 lb. Gross Rail Load;

Standard car equipped with 10'-0" wide by 11'-3½" high insulated single plug door 15" end-of-car cushioning unit;

Meets AAR Plate "F" Clearance Diagram;

State-of-the art temperature control unit, exterior service platform and interior access door;

Satellite monitoring and control system;

An airflow management system installed in the interior of the composite box structure;

High performance insulating materials;

Durable, wood free interior materials; and

No ferrous metals in the interior.

| | |
|---|---|
| Length Inside | 72'-2" |
| Length Over Coupler Pulling Faces | 82'-2" |
| Length over Strikers | 77'-10" |
| Length Between Truck Centers | 52'-0" |
| Truck Wheel Base | 5'-10" |
| Width, Extreme | 10'-6⅝" |
| Width, Inside | 9'-2" |
| Height, Extreme | 16"-11⅞" |
| Height Inside at Center Line of Car | 12'-1½" |
| Estimated Lightweight | 105,000 lbs. |
| Estimated Load Limit- | 181,000 lbs. |
| Based on 286,000 lbs. Gross Rail Load | |
| Gross Rail Load | 286,000 lbs. |
| Cubic Capacity (Between bulkheads) | 8,012 cubic feet |
| Cubic Capacity | 7,883 cubic feet |
| (Level with height of sides) | |

Although the present invention and its advantages have been described in detail, it should be understood that various changes, substitutions and alternations can be made herein without departing from the spirit and scope of the invention as defined by the following claims.

What is claimed is:

1. An insulated railway boxcar comprising:

a railway car underframe having a floor assembly mounted thereon and attached thereto;

the railway car underframe and the floor assembly each having generally elongated, rectangular configurations;

a pair of side wall assemblies respectively mounted on and attached to opposite sides of the railway car underframe;

a pair of end wall assemblies respectively mounted on and attached to opposite ends of the railway car underframe;

each side wall assembly formed from a plurality of metal sheets, support posts, layers of fiber reinforced plastic and foam insulation;

each end wall assembly formed from a plurality of metal sheets, end beams, layers of fiber reinforced plastic and foam insulation;

exterior surfaces of the metal sheets cooperating with each other to form exterior surfaces of the insulated railway car box;

each support post and each end beam having a first surface and a second surface;

the first surfaces of each support post and each end beam respectively attached to interior surfaces of adjacent metal sheets;

the support posts and end beams spaced from each other to partially define void spaces with respect to the interior surfaces of adjacent metal sheets;

respective isolators attached to the second surface of each support post and each end beam;

the layers of fiber reinforced plastic disposed on the isolators and covering respective void spaces defined in part by the interior surfaces of the adjacent metal sheets and the associated support posts or end beams; and the foam insulation disposed within each void space and bonded with interior surfaces of adjacent metal sheets, associated support posts or end beams and adjacent portions of respective layers of the fiber reinforced plastic.

2. The insulated railway boxcar of claim 1 further comprising each isolator formed in part from a polyvinyl chloride material.

3. The insulated railway boxcar of claim 1 wherein the layers of fiber reinforced plastic further comprise a ballistic resistant fabric.

4. The insulated railway boxcar of claim 1 further comprising the isolators formed from blocks of insulating material and blocks of foam insulation disposed between adjacent isolators.

5. The insulated railway boxcar of claim 1 further comprising:

a first layer of fiber reinforced plastic respectively disposed on the isolators; and a second layer of fiber reinforced plastic disposed on the first layer and the isolators.

6. The insulated railway boxcar of claim 5 wherein the second layer of fiber reinforced plastic comprises a generally corrugated cross section which forms multiple airflow paths between the first layer of fiber reinforced plastic and the second layer of fiber reinforced plastic.

7. The insulated railway boxcar of claim 1 wherein each side wall assembly further comprises:

a side sill assembly formed as an integral component thereof;

portions of the side sill assembly attached to the associated metal sheets; and portions of the side sill assembly bonded with the foam insulation.

8. The insulated railway boxcar of claim 1 further comprising:

the metal sheets formed from the group consisting of steel alloys and aluminum alloys; and the support posts and end beams formed from the group consisting of steel alloys, aluminum alloys and composite materials.

9. The insulated railway boxcar of claim 1 further comprising insulating foam formed in place by injecting liquid insulating material at joints between the side wall assemblies and the end wall assemblies.

10. A temperature controlled railway car comprising:

a railway car underframe having a floor assembly mounted thereon and attached thereto;

the railway car underframe and the floor assembly having generally elongated, rectangular configurations;

a pair of side wall assemblies mounted on and attached to opposite sides of the railway car underframe;

a pair of end wall assemblies mounted on and attached to opposite ends of the railway car underframe;

a roof assembly attached to the side wall assemblies and the end wall assemblies opposite from the floor assembly;

each side wall assembly formed from a plurality of metal sheets attached to and extending between a respective top chord and a respective side sill assembly formed as integral components of the side wall assembly;

the metal sheets having respective exterior surfaces and interior surfaces;

a plurality of support posts respectively attached to the interior surfaces of the metal sheets;

layers of fiber reinforced plastic disposed on the support posts opposite from the metal sheets; and foam insulation disposed between and bonded with respective interior surfaces of the metal sheets, portions of the support posts and the layers of fiber reinforced plastic.

11. The temperature controlled railway car of claim 10 further comprising:

an opening formed in one of the end wall assemblies;

at least a portion of a temperature control unit disposed within the opening formed in the one end wall assembly; and an airflow path formed by portions of the roof assembly, side wall assemblies, end wall assemblies and floor assembly to direct airflow from the temperature control unit to lading carried within the railway car.

12. The temperature controlled railway car of claim 10, further comprising:

each side wall assembly having an opening formed therein to provide access to the interior of the railway car;

a respective door frame assembly disposed adjacent to the perimeter of each opening to attach a railway car door thereto; and pultruded strips of glass fiber trim attached to portions of each door frame assembly to minimize heat transfer between the interior and the exterior of the railway car proximate the respective opening in each side wall assembly.

13. The temperature controlled railway car of claim 10 further comprising insulating foam poured in place at respective corner joints between the side wall assemblies and the end wall assemblies to minimize heat transfer between the interior and the exterior of the railway car proximate the corner joints.

14. The temperature controlled railway car of claim 10 further comprising:

a respective joint formed between each side wall assembly and the roof assembly;

each joint extending longitudinally from a first end of the side wall assembly to a second of the side wall assembly;

each joint filled with an insulating foam to minimize heat transfer between the interior and the exterior of the railway car proximate the respective joint; and a layer of trim molding bonded with the insulating foam.

15. The temperature controlled railway car of claim 14 further comprising at least a portion of the insulating foam at each joint formed in place by injecting liquid insulating foam into the joint after coupling the roof assembly with the respective side wall assembly.

16. A temperature controlled railway boxcar comprising:

a railway car underframe having a generally rectangular configuration defined in part by a plurality of cross bearers, cross ties and longitudinal stringers for mounting the composite box structure thereon;

a pair of substantially rectangular side wall assemblies mounted on and secured with opposite sides of the railway car underframe;

each side wall assembly having a top chord attached to and extending along an upper edge and a side sill assembly attached to and extending along a lower edge;

an opening formed in each side wall assembly to provide access to an interior of the composite box structure for loading and unloading lading;

a pair of substantially rectangular end wall assemblies mounted on and secured with opposite ends of the railway car underframe;

each end wall assembly having a top plate attached to and extending along a upper edge and at least a portion of an end sill assembly attached to and extending along a lower edge;

the end wall assemblies and the side wall assemblies joined with each other at respective corner joints;

a substantially rectangular floor assembly mounted on the railway car underframe;

the floor assembly extending between and joined with portions of the side wall assemblies and portions of end wall assemblies adjacent to the railway car underframe;

a substantially rectangular roof assembly mounted on and attached to the top chord of each side wall assembly and the top plate of each end wall assembly;

each side wall assembly having an exterior metal surface formed by a plurality of metal sheets attached to the respective top chord and side sill assembly;

each end wall assembly having an exterior metal surface formed by a plurality of metal sheets attached to the respective top plate and the portion of the end sill assembly;

each side wall assembly having an interior surface formed by a plurality of layers of fiber reinforced plastic;

each end wall assembly having an interior surface formed by at least one layer of fiber reinforced plastic;

insulating foam respectively disposed between and bonded with the interior surfaces of the metal sheets and the layers of fiber reinforced plastic used to form the respective side wall assemblies; and insulating foam respectively disposed between and bonded with the interior surfaces of the metal sheets and the layers of fiber reinforced plastic used to form the end wall assemblies.

17. A composite box structure mounted on a railway car underframe comprising:

a pair of opposite substantially rectangular side wall assemblies;

each side wall assembly defined in part by a respective top chord and a respective side sill assembly extending longitudinally from one end of the respective side wall assembly to the other end of the respective side wall assembly;

the top chord and the side sill assembly formed as integral components of each respective side wall assembly;

an opening formed intermediate the ends of each side wall assembly to provide access to the interior of the composite box structure for loading and unloading lading;

a pair of opposite substantially rectangular end wall assemblies;

each end wall assembly having a top plate and a end sill assembly extending between opposite sides of the respective end wall assembly;

a substantially rectangular floor assembly mounted and attached to the railway car under frame;

the floor assembly extending between and joined with lower portions of the side wall assemblies and the end wall assemblies;

the side wall assemblies and the end wall assemblies having a generally smooth exterior surface formed by a plurality of metal sheets;

the metal sheets having respective exterior surfaces and interior surfaces;

support posts attached to the interior surfaces of the metal sheets;

respective isolators attached to each support post opposite from the metal sheets;

at least one layer of ballistic resistant fabric disposed on the isolators opposite from the support posts; and foam insulation disposed between and bonded with the support posts, adjacent interior surfaces of the metal sheets and the ballistic resistant fabric.

* * * * *